US008231123B2

(12) United States Patent
Tsuchiyama et al.

(10) Patent No.: US 8,231,123 B2
(45) Date of Patent: Jul. 31, 2012

(54) AUTOMATIC PAPER FEEDER

(75) Inventors: Yoshiki Tsuchiyama, Kahoku (JP); Satoshi Ishida, Kahoku (JP); Yasunori Miyauchi, Kahoku (JP); Shuuichi Morikawa, Kahoku (JP)

(73) Assignee: PFU Limited, Ishikawa (JP)

( * ) Notice: Subject to any disclaimer, the term of this patent is extended or adjusted under 35 U.S.C. 154(b) by 1321 days.

(21) Appl. No.: 10/580,211

(22) PCT Filed: Aug. 31, 2005

(86) PCT No.: PCT/JP2005/015845

§ 371 (c)(1),
(2), (4) Date: May 23, 2006

(87) PCT Pub. No.: WO2006/035568

PCT Pub. Date: Apr. 6, 2006

(65) Prior Publication Data

US 2007/0114712 A1 May 24, 2007

(30) Foreign Application Priority Data

Sep. 29, 2004 (JP) ..... 2004-283936

(51) Int. Cl.
*B65H 3/52* (2006.01)

(52) U.S. Cl. ..... 271/124; 271/121

(58) Field of Classification Search ..... 271/124, 271/121, 137, 138

See application file for complete search history.

(56) References Cited

U.S. PATENT DOCUMENTS

| | | | | |
|---|---|---|---|---|
| 4,605,217 | A * | 8/1986 | Goi | 271/124 |
| 4,674,737 | A * | 6/1987 | Murayoshi | 271/124 |
| 4,844,437 | A * | 7/1989 | Tanaka et al. | 271/124 |
| 5,052,676 | A | 10/1991 | Shiina et al. | |
| 5,104,113 | A | 4/1992 | Kameyama et al. | |
| 5,193,798 | A * | 3/1993 | Okano | 271/124 |
| 6,672,580 | B2 * | 1/2004 | Shibata et al. | 271/124 |

FOREIGN PATENT DOCUMENTS

DE 27 04 045 8/1978

(Continued)

OTHER PUBLICATIONS

Japanese Patent Office Action, mailed May 15, 2007 and issued in corresponding Japanese Patent Application No. 2004-283936.

(Continued)

*Primary Examiner* — Jeremy R Severson
(74) *Attorney, Agent, or Firm* — Staas & Halsey LLP

(57) ABSTRACT

An arrangement is provided such that a pad pressing means for pressing a separation pad against a pick roller is formed in a reverse U-shape, and a pressing spring for pressing the pad pressing means to press the separation pad against the pick roller is provided on a central portion of the pad pressing means.

The pad pressing means is structured so as to have a rotating fulcrum to be rotatable back and forth with respect to a rotating direction of the pick roller about a connecting portion of the pad pressing means for connection to the pressing spring. To ensure that a large load will not be applied to the entire pad pressing means when thick paper or the like is fed, a rotating arm may be provided so that the entire pressing means including the pad pressing means is rotatable about a predetermined position set at the rotating fulcrum which is the connecting portion for connection to the pressing spring.

9 Claims, 4 Drawing Sheets

FOREIGN PATENT DOCUMENTS

| | | |
|---|---|---|
| DE | 689 19 442 | 4/1995 |
| GB | 1 592 241 | 7/1981 |
| JP | 60-56746 | 4/1985 |
| JP | 63-258335 | 10/1988 |
| JP | 5-22432 | 3/1993 |
| JP | 8-91609 | 4/1996 |
| JP | 2000-185837 | 7/2000 |
| JP | 2001-63854 | 3/2001 |
| JP | 2002-370838 | 12/2002 |

OTHER PUBLICATIONS

Office Action dated Aug. 29, 2007 and issued in corresponding German Patent Application No. 11 2005 000 135.0-27.

* cited by examiner

AUTOMATIC PAPER FEEDER

This application claims the benefit of PCT International Application Number PCT/JP2005/015845, filed Aug. 31, 2005 and Japanese Application No. 2004-283936, filed Sep. 29, 2004, in Japan, the disclosures of which are incorporated herein by reference.

TECHNICAL FIELD

The present invention relates to an automatic paper feeder for automatically feeding paper to an apparatus such as a printer or a scanner, and relates an automatic paper feeder for realizing the feeding of paper one sheet at a time reliably.

BACKGROUND ART

In a conventional paper feeder, when paper stacked in a stacker is picked by a pick roller, paper 54 is arranged to be inserted into a portion between a pick roller 50 and a separation pad 51 and to be transported one sheet at a time into an apparatus by making use of a frictional force, as shown in FIG. 5.

The arrangement provided is such that, to ensure that a sufficient frictional force acts between the pick roller 50 and the separation pad 51 at that time, a pad pressing means 52 is provided which applies a pressing force for causing the separation pad 51 to come into contact with the surface of the pick roller 50 by means of a pressing spring 53 so as to cause the separation pad 51 to contact the pick roller 50.

With such a structure, however, the area where the separation pad 51 comes into contact with the pick roller 50 inevitably becomes small, so that there have been cases where a plurality of overlapping sheets cannot be separated by the separation pad 51, resulting in the occurrence of multi-feeding.

Accordingly, an automatic paper feeder has been devised in which the shape of the pad pressing means 52 for applying a pressing force to the separation pad 51 is formed in a reverse U-shape, whereby the separation pad 51 can be pressed at two portions thereof against the surface of the pick roller 50, making it possible to more reliably separate the sheets one by one (e.g., refer to patent document 1).

Even with such a structure, however, the distribution of pressure applied at two front and rear portions of the pad pressing means 52 is not uniform owing to the contact between the paper 54 and the pad 51, so that there have been cases where the sheets cannot be reliably separated one by one.

Patent document 1: JP-A-8-91609

DISCLOSURE OF THE INVENTION

Problems to be Solved by the Invention

As described above, the following problems are encountered in the conventional art.

To pick the paper sheets stacked in such as the stacker one by one, the separation pad is provided with the pick roller, and the separation of the sheets is effected by the frictional force acting between the pick roller and the separation pad. However, if the arrangement provided is such that the pad pressing means for pressing the separation pad against the pick roller is pressed at one portion, it is difficult to optimize the pressure applied to the separation pad, resulting in the occurrence of a transport error such as multi-feeding.

To overcome this problem, there is an automatic paper feeder in which the pad pressing means is formed in the reverse U-shape, whereby the separation pad is pressed at the two front and rear portions thereof against the pick roller to ensure that a transport error such as multi-feeding does not occur. However, depending on the type of paper, the pressure applied at the two front and rear portions of the separation pad does not become uniform, so that there have been cases where a transport error occurs.

An object of this invention is to provide an automatic paper feeder which is used for such as a printer or a scanner to automatically transport paper to the apparatus, and which allows the paper stacked in a stacker or the like to be reliably transported one sheet at a time into the apparatus.

Means for Overcoming the Problems

To overcome the above-described problems, the following means are adopted in this invention.

An arrangement is provided such that a pad pressing means for pressing a separation pad against a pick roller is formed in a reverse U-shape, and a pressing spring for pressing the pad pressing means to press the separation pad against the pick roller is provided on a central portion of the pad pressing means.

The pad pressing means is structured so as to have a rotating fulcrum to be rotatable back and forth with respect to a rotating direction of the pick roller about a connecting portion of the pad pressing means for connection to the pressing spring.

To ensure that a large load will not be applied to the entire pad pressing means when thick paper or the like is fed, a rotating arm may be provided so that the entire pressing means including the pad pressing means is rotatable about a predetermined position set at the rotating fulcrum which is the connecting portion for connection to the pressing spring.

In addition, the position where the pressing spring is connected to the pad pressing means may be made movable back and forth instead of being fixed at the rotating fulcrum at the central portion of the pad pressing means.

By adopting the above-described means, an optimum frictional force is generated as the frictional force occurring between the pick roller and the separation pad irrespective of the type of paper, thereby making it possible to reliably separate the paper one by one and feed it into the apparatus.

Advantages of the Invention

As a result of this invention, it is possible to expect the following advantages.

When the paper stacked in the stacker or the like is fed into an apparatus by the pick roller, it becomes possible to reliably separate the paper one by one and feed it into the apparatus irrespective of the type of paper.

DESCRIPTION OF THE REFERENCE NUMERALS AND SIGNS

Figure 1:
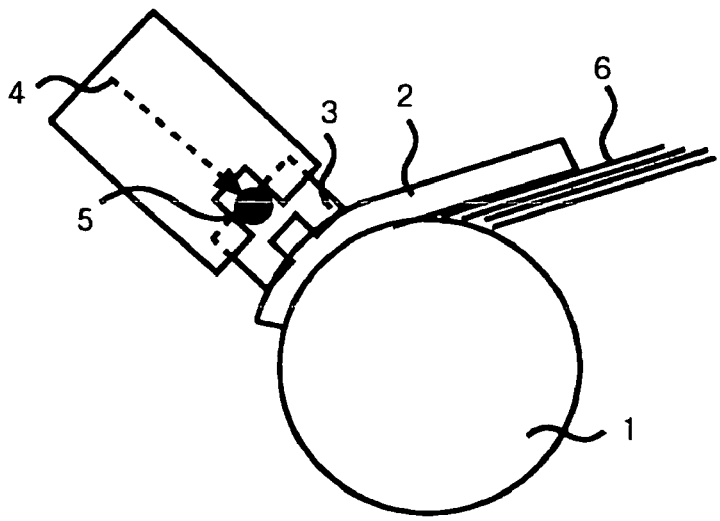
FIG. 1 is an overall schematic diagram of the invention.

1: pick roller
2: separation pad
3: pad pressing means
4: pressing spring
5: rotating fulcrum
6: paper
7: rotating arm

BEST MODE FOR CARRYING OUT THE INVENTION

In the invention, the following embodiment is adopted.

An arrangement is provided such that a pressing spring and a pad pressing means are provided to allow a separation pad is brought into contact with a pick roller with an appropriate force.

As a result, even in cases where a plurality of sheets are picked by the pick roller, the paper can be fed into the apparatus after being separated one by one by a frictional force at the portion of contact between the separation pad and the pick roller.

Further, the pad pressing means is formed into a reverse U-shape, so that the separation pad is arranged to be pressed at two front and rear portions thereof against the pick roller.

As a result, it becomes possible to separate the plurality of sheets one by one more stably than in the case where the separation pad is pressed at one portion thereof against the pick roller.

Further, a rotating fulcrum is provided at a central portion of the pad pressing means, and a pressing force based on the pressing spring is arranged to be applied here.

In consequence, the pressure applied to the separation pad can be made into uniform pressure at two front and rear portions, thereby making it possible to perform stable separation processing of the paper.

In addition, an arrangement may be provided such that a rotating arm is provided at the rotating fulcrum of the pad pressing means so that the pad pressing means becomes rotatable about a predetermined position.

As a result, in a case where the picked paper is thick, it becomes possible to suppress the picked paper from pushing up the separation pad with a strong force and an excessive force from being applied to the pad pressing means, making it possible to apply an appropriate force to the separation pad.

In addition, the position where pressure is applied to the pad pressing means by the pressing spring may be arranged to be freely changed back and forth instead of being fixed at the central portion of the pad pressing means.

In consequence, in a case where the thickness of the paper which is to be picked is thin, a greater pressure can be applied to the front side, making it possible to make the multi-feeding or the like difficult to occur. Meanwhile, in a case where the thickness of the paper is thick, a greater pressure can be applied to the rear side, making it possible to make the multi-feeding or the like difficult to occur.

EMBODIMENT

A description will be given of a representative embodiment in accordance with the invention. It should be noted that in the description below the same portions are denoted by the same reference numerals, and a detailed description thereof will be omitted in some cases.

FIG. 1 shows an embodiment of the invention.

In the drawing, paper 6 is picked by a pick roller 1 and is inserted into a portion between the pick roller 1 and a separation pad 2, and only one sheet among a plurality of paper sheets is arranged to be picked by means of a frictional force.

In this device, a pad pressing means 3 for applying pressure to the separation pad 2 is provided so that the frictional force between the pick roller 1 and the separation pad 2 becomes a force appropriate for the separation processing of the paper.

A pressing force is applied to the separation pad 2 by this pad pressing means 3 so that the separation pad 2 comes into contact with the surface of the pick roller 1. However, in a case where the pressing is effected at one point, it is difficult to obtain an appropriate frictional force, and a picking error such as multi-feeding is likely to occur.

Accordingly, in this device, the pad pressing means 3 is formed in a reverse U-shape so that the separation pad 2 is arranged to be pressed at two front and rear portions thereof.

As a result, since the frictional force can be applied in a wide range, the pressing can be effected so that the frictional force is made appropriate more easily than in the case where the pressing is effected at one point.

However, if the pad pressing means 3 is merely formed in the reverse U-shape, there are cases where uniform pressure cannot be applied at the two front and rear portions owing to the difference in such as the thickness of the paper used, making it impossible to obtain an appropriate frictional force.

Accordingly, in this device, a rotating fulcrum 5 is provided at a connecting portion of the pad pressing means 3 for connection to a pressing spring 4 for applying pressure to the pad pressing means 3, so that the pad pressing means 3 is structured to be rotatable back and forth with respect to the rotating direction of the pick roller 1, to ensure that the pressure applied to the two front and rear portions can be made uniform.

Figure 2:
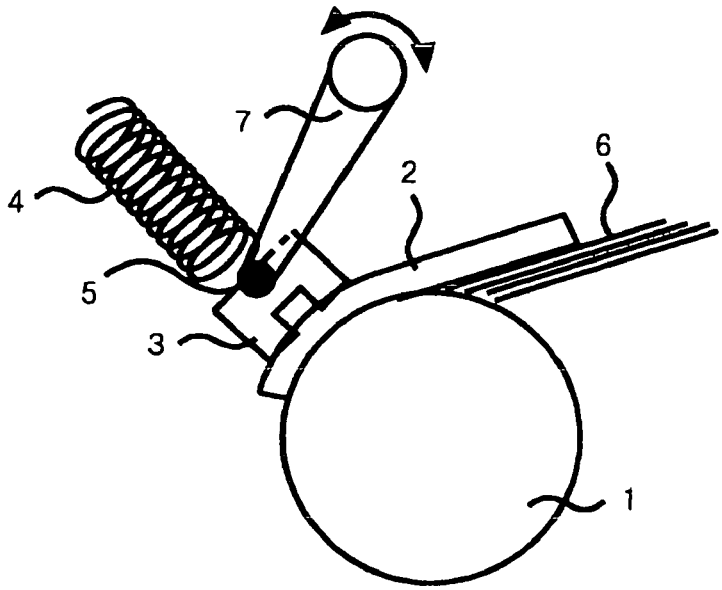
FIG. 2 is an explanatory diagram in a case where a rotating arm is provided.

In addition, as shown in FIG. 2, a rotating arm 7 which is rotatable about a predetermined position may be provided at the rotating fulcrum 5 so that an excessive force will not be applied to the entire pressing means depending on the thickness of the paper which is fed.

As a result, although there have been cases where the pressure applied to the two front and rear portions by the pad pressing means 3 fails to be held uniformly and a picking error occurs, the pressure can be held uniformly, making it possible to prevent the occurrence of a picking error.

Figure 3:
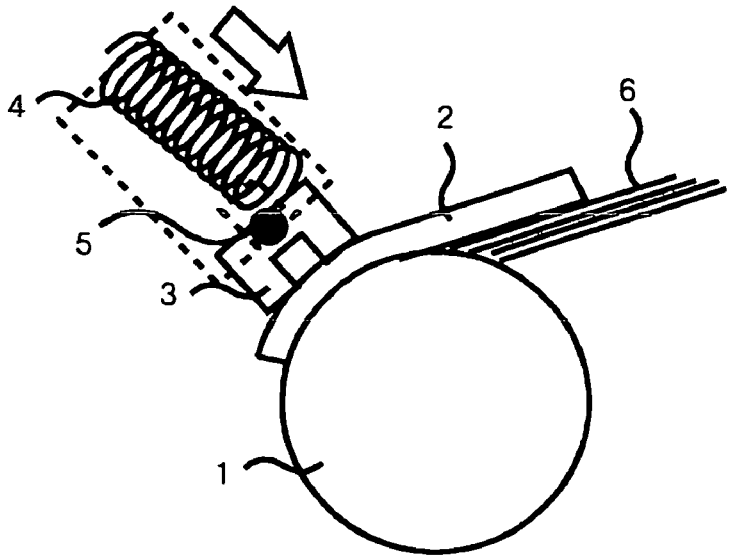
FIG. 3 is an explanatory diagram in a case where a pressing spring is provided in the front.

In addition, if the position of the pressing means 4 for applying pressure to the pad pressing means 3 is disposed forwardly of the center of the pad pressing means 3, as shown in FIG. 3, a greater force can be applied to the front side of the two portions where the pressure is applied to the separation pad 2 by the pad pressing means 3. Hence, the separation processing of the paper can be performed reliably even in cases where the paper is thin and multi-feeding is likely to occur.

Figure 4:
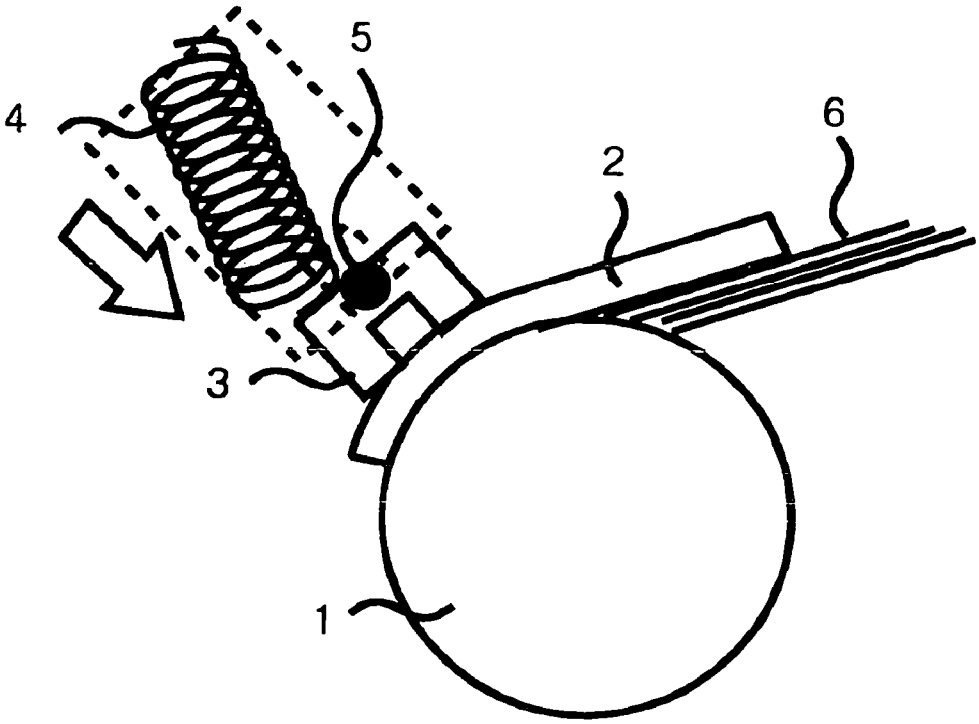
FIG. 4 is an explanatory diagram in a case where the pressing spring is provided in the rear.
Figure 5:
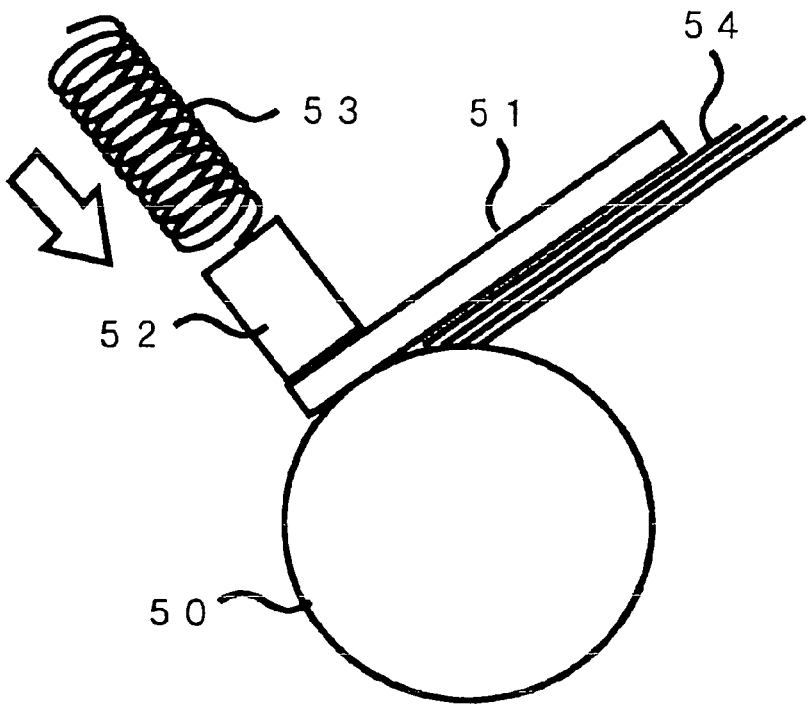
PRIOR ART Fig. 5
FIG. 5 is an explanatory diagram of a conventional pressing means for pressing against a separation pad.
Figure 6:
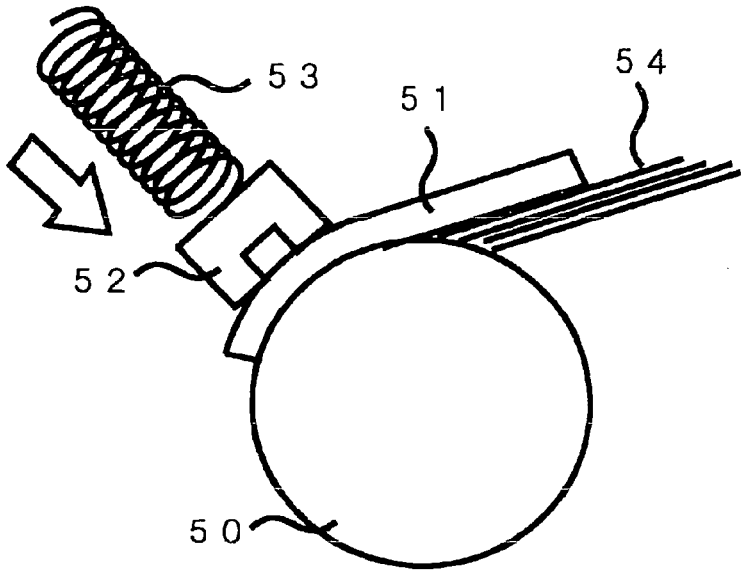
PRIOR ART Fig-6
FIG. 6 is an explanatory diagram in a case where a conventional reverse U-shaped pad pressing means is used.

Conversely, if the position of the pressing means 4 for applying pressure to the pad pressing means 3 is disposed backwardly of the center of the pad pressing means 3, as shown in FIG. 4, a greater force can be applied to the rear side of the two portions where the pressure is applied to the separation pad 2 by the pad pressing means 3. Hence, the separation processing of the paper can be performed reliably even in cases where the paper is thick and jamming is likely to occur.

The position of the pressing means 4 for applying pressure to the pad pressing means 3 may be made selectable so as to perform optimal separation processing in conformity with the paper.

The invention claimed is:

1. An automatic paper feeder supplying paper to an apparatus, comprising:

a separation pad, pressing the paper against a pick roller so as to feed the paper one by one; and pad pressing means, applying pressure to the separation pad so as to press the separation pad against a surface of the pick roller, the pad pressing means having a reverse U-shape to press the separation pad against the surface of the pick roller at two portions, a front portion and a rear portion, along a rotating direction of the pick roller thereof, and the pad pressing means being configured to be rotatable back and forth with respect to the rotating direction of the pick roller about a fulcrum where pressure is applied to the pad pressing means, wherein the fulcrum where the pressure is applied to the pad pressing means is arranged such as to be movable back and forth depending on a type of the paper which is fed between the separation pad and the pick roller.

2. The automatic paper feeder according to claim 1, further comprising:

a rotating arm arranged so that the pad pressing means is rotatable about a predetermined position.

3. The automatic paper feeder according to claim 2, wherein the fulcrum where the pressure is applied to the pad pressing means is arranged such as to be movable back and forth depending on a type of the paper which is fed between the separation pad and the pick roller.

4. The automatic paper feeder according to claim 1, further comprising a pressing unit applying the pressure to the fulcrum of the pad pressing means.

5. A method of adjusting pad pressing means pressing on a pick roller of an automatic paper feeder depending on thickness of paper fed between the pad pressing means and the pick roller, the pad pressing means pressing the pick roller in at least two distinct portions, the method comprising:

rotating the pad pressing means about a fulcrum where pressure is applied to the pad pressing means to adjust pressures on the at least two distinct portions; and adjusting position of the fulcrum closer or farther from the pick roller.

6. An automatic paper feeder supplying paper to an apparatus, comprising:

a separation pad, pressing the paper against a pick roller so as to feed the paper one by one; and pad pressing means, applying pressure to the separation pad so as to press the separation pad against a surface of the pick roller, the pad pressing means having a reverse U-shape to press the separation pad against the surface of the pick roller at two portions, a front portion and a rear portion, along a rotating direction of the pick roller thereof, and the pad pressing means being configured to be rotatable back and forth with respect to the rotating direction of the pick roller about a fulcrum where pressure is applied to the pad pressing means, wherein the fulcrum where the pressure is applied to the pad pressing means is arranged such as to be movable closer or farther to the pick roller depending on a thickness of the paper which is fed between the separation pad and the pick roller.

7. The automatic paper feeder according to claim 6, further comprising:

a rotating arm arranged so that the pad pressing means is rotatable about a predetermined position.

8. The automatic paper feeder according to claim 7, wherein the fulcrum where the pressure is applied to the pad pressing means is arranged such as to be movable back and forth depending on a type of the paper which is fed between the separation pad and the pick roller.

9. The automatic paper feeder according to claim 6, further comprising a pressing unit applying the pressure to the fulcrum of the pad pressing means.

* * * * *